US010849362B2

(12) United States Patent
Jiang et al.

(10) Patent No.: US 10,849,362 B2
(45) Date of Patent: Dec. 1, 2020

(54) ATOMIZER WITH EASY ASSEMBLY AND DISASSEMBLY AND ELECTRONIC CIGARETTE HAVING SAME

(71) Applicant: Shenzhen First Union Technology Co., Ltd., Shenzhen (CN)

(72) Inventors: Zhanjun Jiang, Shenzhen (CN); Yonglu Guo, Shenzhen (CN); Yonghai Li, Shenzhen (CN); Zhongli Xu, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 237 days.

(21) Appl. No.: 15/923,103

(22) Filed: Mar. 16, 2018

(65) Prior Publication Data

US 2018/0263287 A1 Sep. 20, 2018

(30) Foreign Application Priority Data

Mar. 17, 2017 (CN) ..... 2017 2 0264348 U

(51) Int. Cl.

| | |
|---|---|
| ***A24F 13/00*** | (2006.01) |
| ***A24F 47/00*** | (2020.01) |
| ***H05B 3/42*** | (2006.01) |

(52) U.S. Cl.

CPC ..... *A24F 47/008* (2013.01); *H05B 3/42* (2013.01); *H05B 2203/021* (2013.01)

(58) Field of Classification Search

CPC ..... A24F 47/00

USPC ..... 131/328–329

See application file for complete search history.

(56) References Cited

U.S. PATENT DOCUMENTS

| | | | | |
|---|---|---|---|---|
| 2014/0353856 | A1 | 12/2014 | Dubief | |
| 2016/0249683 | A1* | 9/2016 | Li | A24F 47/008 131/329 |
| 2018/0027874 | A1* | 2/2018 | Zhu | H05B 3/03 |

FOREIGN PATENT DOCUMENTS

| | | | |
|---|---|---|---|
| CN | 204 032 373 | U | 12/2014 |
| CN | 204 070 573 | U | 1/2015 |
| CN | 105 212 278 | A | 1/2016 |
| EP | 3 025 602 | A2 | 6/2016 |
| EP | 3 047 743 | A1 | 7/2016 |
| WO | 2015/062136 | A1 | 5/2015 |
| WO | 2016033741 | A1 | 3/2016 |

* cited by examiner

*Primary Examiner* — Phuong K Dinh

(74) *Attorney, Agent, or Firm* — Proi Intellectual Property US; Klaus Michael Schmid

(57) ABSTRACT

An atomizer with easy assembly and disassembly is disclosed including: an atomizer body; a liquid storage chamber formed inside the atomizer body and configured for storing the tobacco liquid; an aerosol generator, configured for aerosolizing tobacco liquid from the liquid storage chamber to generate an aerosol, and capable of being inserted into the tobacco liquid chamber from an end of the atomizer body; an air pipe, disposed inside the atomizer body and configured for conducting the aerosol generated by the aerosol generator; and a base component, connecting an end of the aerosol body by snap joint; the base component abuts against a first end of the aerosol generator such that a second end of the aerosol generator connects the air pipe.

15 Claims, 6 Drawing Sheets

ATOMIZER WITH EASY ASSEMBLY AND DISASSEMBLY AND ELECTRONIC CIGARETTE HAVING SAME

TECHNICAL FIELD

The present disclosure relates to the field of electronic cigarette sets, and in particular, to an atomizer with easy assembly and disassembly, and an electronic cigarette having same.

BACKGROUND ART

Currently, in market, an aerosol generator, also called an atomizer head in an atomizer of the electronic cigarette can be disassembled. The aerosol generator is mounted inside the atomizer by a thread, and carried on the bottom of the atomizer by means of a base component that is configured for fixing and positioning the aerosol generator. The aerosol generator, the base component are connected with the atomizer by means of the thread, which makes designing and assembling of components in the atomizer costly, resulting in high cost for manual operation but low efficiency. When the user replaces the aerosol generator for the atomizer, that is, the atomizer head, the tobacco liquid outside of the aerosol generator will be contacted, which causes a bad operation experience and inconvenience to use the atomizer.

SUMMARY

The present disclosure relates essentially to an atomizer with easy assembly and disassembly for replacing the aerosol generator more conveniently, which has a simple structure, and an electronic cigarette having same.

To overcome the above drawbacks, according to embodiments of the present disclosure, an atomizer with easy assembly and disassembly including: an atomizer body, having a liquid storage chamber formed therein; an aerosol generator, configured for aerosolizing tobacco liquid from the liquid storage chamber to generate an aerosol, and capable of being inserted into the tobacco liquid chamber from an end of the atomizer body; an air pipe, disposed inside the atomizer body and configured for conducting the aerosol generated by the aerosol generator; and a base component, connecting an end of the aerosol body by snap joint; the base component abuts against a first end of the aerosol generator such that allows a second end of the aerosol generator to connect the air pipe.

Furthermore, the air pipe includes a pipe cavity, configured for receiving the second end of the aerosol generator by inserted into; inside the pipe cavity includes an elastic element, the elastic element abuts against the second end of the aerosol generator.

Furthermore, the elastic element includes a spring and a moving sleeve capable of sliding along the pipe cavity; the second end of the aerosol generator abuts inside of the moving sleeve.

According to embodiments of the present disclosure, inside wall of the moving sleeve has a boss, the second end of the aerosol generator has a flange configured for abutting against the boss.

According to embodiments of the present disclosure, the base component has a notch along an axis direction of the base component, and a first arc groove along a radial direction thereof; an end of the atomizer body connected with the base component has at least a first protruding part configured for catching the first arc groove by snap joint after inserted through the notch and rotated with a certain angle.

Furthermore, an end of the atomizer body includes an arc slit for limiting the angle of the base component rotated; the base component includes a lug clamped with the arc slit.

According to embodiments of the present disclosure, the aerosol generator includes a housing, a heating element being disposed in the housing and an annular liquid storage space surrounding the heating element; the housing has a liquid inlet, the tobacco liquid from the liquid storage space is absorbed through the liquid inlet and heated to generate an aerosol.

According to embodiments of the present disclosure, the second end of the aerosol generator away from the connected base component is connected with a mouth piece by snap joint, and includes a second arc groove; a second protruding part is defined on the mouth piece and connected with the second arc groove by snap joint.

An electronic cigarette is further disclosed, including an atomizer and a power supply set connected with the atomizer; the atomizer is referred to aforementioned atomizer with easy assembly and disassembly.

According to another embodiment of the present disclosure, the electronic cigarette includes an atomizer body, a liquid storage chamber formed inside the atomizer body and configured for storing the tobacco liquid; an aerosol generator, configured for aerosolizing tobacco liquid from the liquid storage chamber to generate an aerosol and capable of being inserted into the tobacco liquid chamber from an end of the atomizer body; an air pipe, disposed inside the atomizer body and configured for conducting the aerosol generated by the aerosol generator; and a power supply set, configured for supplying power to the aerosol generator, the power supply set is connected with an end of the atomizer body by snap joint; and the power supply set abuts against a first end of the aerosol generator such that a second end of the aerosol generator connects the air pipe.

Compared to the existing technologies known to the inventors, since the atomizer with easy assembly and disassembly in the present disclosure, the aerosol generator may be disposed inside the liquid storage chamber from an end of the aerosol generator, then the base component is fixedly connected with the aerosol generator by snap joint. The entire structure of the atomizer is easy to assembly, therefore the cost is reduced greatly. When the user replaces the aerosol generator, such as an atomizer head, the atomizer head may be taken out directly without screwing the thread and contacting the tobacco liquid, which is more convenient to operate.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
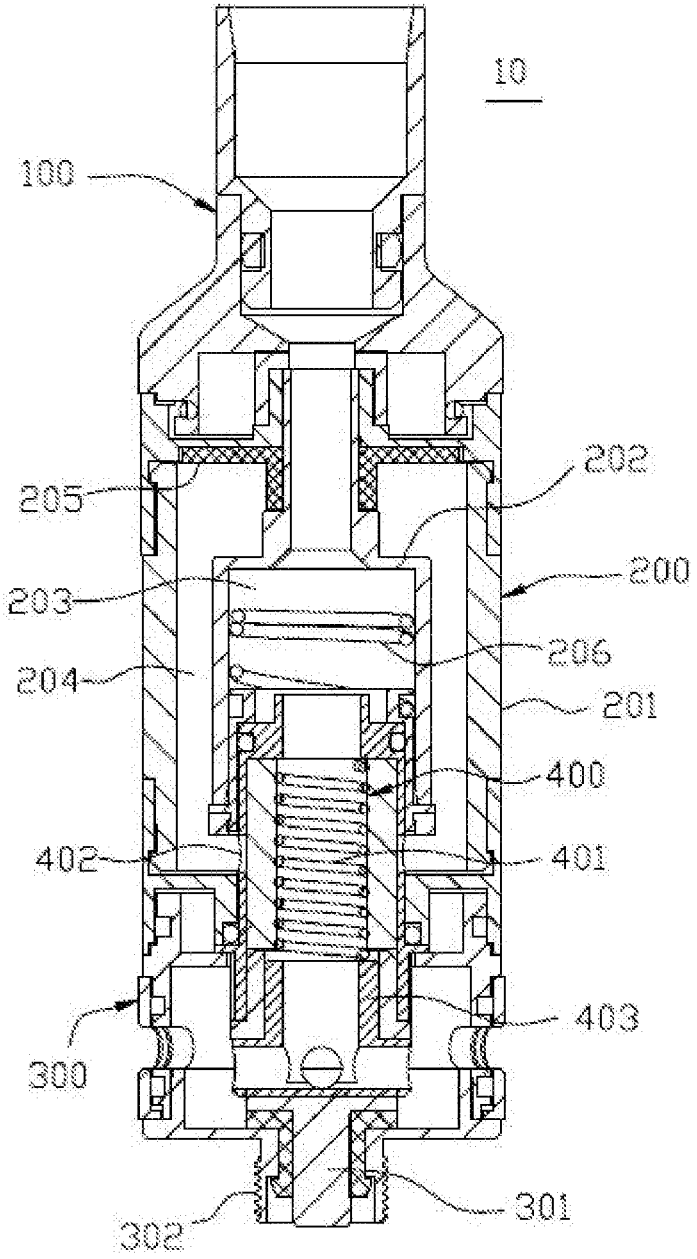
FIG. 1 is a cross-sectional view of an atomizer with easy assembly and disassembly according to embodiments, in which an aerosol generator is assembled in an atomizer body.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
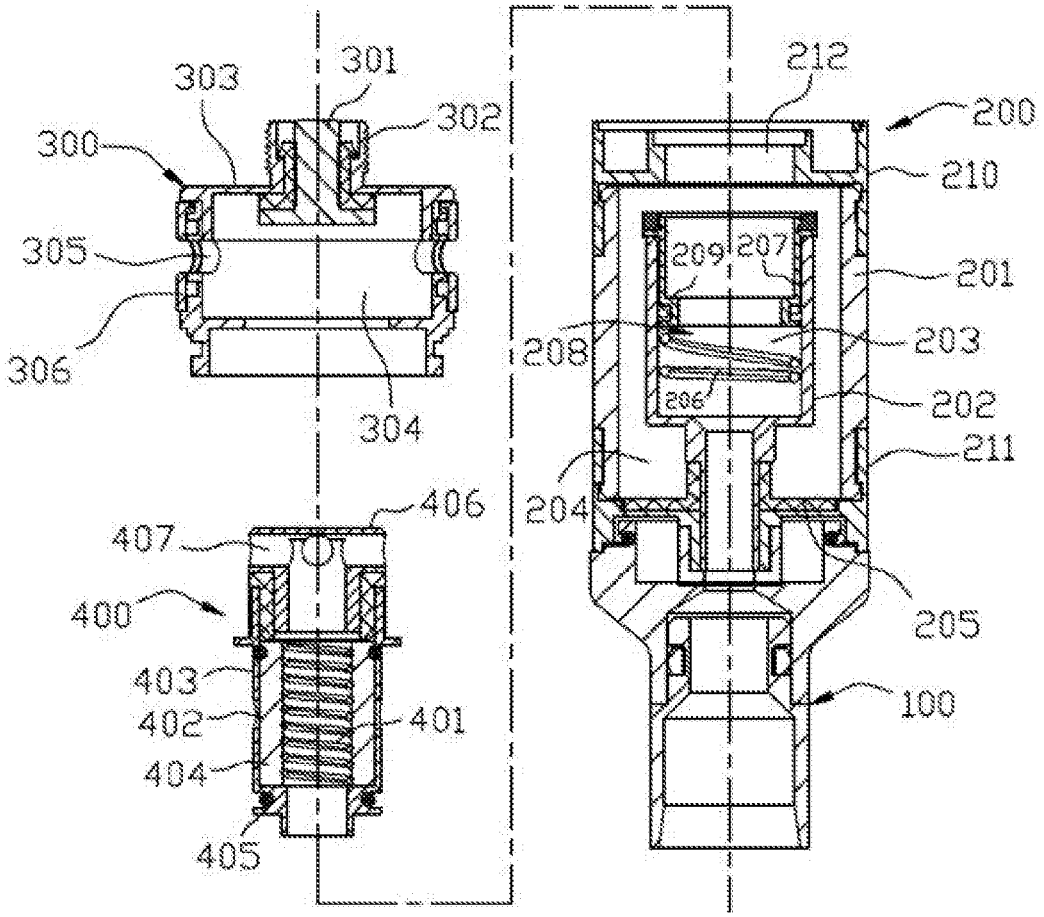
FIG. 2 is a cross-sectional view of the atomizer with easy assembly and disassembly according to embodiments, in which the aerosol generator is disassembled out of the atomizer body.

Referring to FIG. 1 to FIG. 2, the present disclosure relates to an atomizer 10 with easy assembly and disassembly, including an atomizer body 200, a base component 300, a mouth piece 100, an aerosol generator 400 formed inside the atomizer body 200 and an air pipe 202. The base component 300 and the mouth piece 100 are detachably connected with two ends of the atomizer body 200 respectively.

The atomizer body 200 is round-shaped, including a liquid storage chamber 204 configured for storing the tobacco liquid. The tobacco liquid may be heated to form an aerosol, simulating traditional cigarette smoke. In some embodiments, the atomizer body 200 includes a hollow round-shaped sleeve 201 in the middle thereof, a lower holder 210 and an upper holder 211 connected with the round-shaped sleeve 201 respectively. The round-shaped sleeve 201 may be made by transparent material, allowing user to see through the sleeve 201 to the tobacco liquid in the liquid storage chamber 204 and the aerosol generator 400, therefore, the user experience is improved. The lower holder 210 is configured for connecting the base component 300, and a central hole 212 is formed at the central of the lower holder 210; the upper holder 211 is configured for connecting the mouth piece 100.

The aerosol generator 400 is configured for aerosolizing the tobacco liquid to generate an aerosol, defined to be inserted from an end of the atomizer body 200 into the liquid storage chamber 204 that is inserted through the central hole 212 of the lower holder 210. In some embodiments, the aerosol generator 400 includes a housing 403, a heating element 401 disposed in the housing 403 and an annular liquid storage space 404 surrounding the heating element 401; the housing 403 has a liquid inlet 402, the tobacco liquid from the liquid storage space 404 is absorbed through the liquid inlet 402 and heated by the heating element 401 to generate an aerosol. The housing 403 is generally shaped like a tube, surrounding by the tobacco liquid. The liquid inlets 402 may be configured as more than one, uniformly distributed throughout the circle of the housing 403, beneficial for the tobacco liquid to flow into the aerosol generator 400 more uniformly, and finally absorbed by the liquid storage space 404. In some embodiments, the heating element 401 is a helical heating wire, the liquid storage space 404 may be made by some micro-porous materials like the fiber cotton, fiberglass material layer and heat-resistant high polymer epispastic material or micro-porous ceramic etc.

The above air pipe 202 is disposed inside the liquid storage chamber 204 of the atomizer body 200. The air pipe 202 is connected between the above aerosol generator 400 and the mouth piece 100, configured for conducting the aerosol generated by the aerosol generator 400. The air pipe 202 includes a lower pipe with a larger inner diameter and an upper pipe with a smaller inner diameter. The air pipe 202 is sleeved on the upper holder 211 via the upper pipe, and the upper holder 211 is configured for fixing the air pipe 202. When the aerosol generator 400 is mounted into the atomizer body 200, the lower pipe of the air pipe 202 is connected at interior of the aerosol generator 400, the upper pipe is in communication with the mouth piece 100

The base component 300 is connected with an end of the atomizer body 200 by snap joint, the base component 300 abuts against a first end of the aerosol generator 400 such that allows a second end of the aerosol generator 400 to connect the air pipe 202. The base component 300 includes a thread sleeve 303, one end of the thread sleeve 303 has an accommodating chamber 304 for receiving the first end of the aerosol generator 400, between inside wall of the accommodating chamber 304 and outside wall of the aerosol generator 400 has a sealing ring configured to avoid spillage. The other end of the thread sleeve 303 has a conductive thread to connect the outside power supply, in the middle of the thread sleeve 303 has an insulated positive electrode 301, in this case, the thread sleeve 303 works as a negative electrode. In addition, at least one air inlet 305 is arranged on the periphery of the thread sleeve 303, and an adjusting ring 306 is sleeved on the air inlet 305 to adjust the air intake rate of the air inlet 305.

Based on the abovementioned atomizer 10 with easy assembly and disassembly, in some embodiments, it is avoided that the aerosol generator 400 is directly connected with the atomizer body 200, but by using a base component 300 to abut against the aerosol generator 400 and the atomizer body 200, at the same time, connection of the base component 300 and the atomizer body 200 is realized by snap joint which is more convenient, the structure is simple as ridding a thread component. In a process of assembling the aerosol generator 400, firstly reversing the atomizer body 100 then disposing a new aerosol generator 400 into the liquid storage chamber 204 through the central hole 212 of the lower holder 210, at last, the base component 300 is clamped with the lower holder 210. In a process of replacing the aerosol generator 400, open the base component 300 and then the aerosol generator 400 may be taken out.

With reference to FIG. 2, the air pipe 202 has a pipe cavity 203, configured for allowing the second end of the aerosol generator 400 inserting into; inside the pipe cavity 203 includes an elastic element 208, the elastic element 208 abuts against the second end of the aerosol generator 400. A first end of the aerosol generator 400 has an electrode connector 406 of connecting the heating element 401. An air hole 407 is defined on the sidewall of the electrode connector 406. When the base component 300 abuts against the aerosol generator 400 to push it inserted into the air pipe 202, the elastic element 208 is then compressed to cause the electrode connector 406 contacting well with the positive electrode 301 of the base component 300 while the housing 403 also connects the heating element 401. In this case, the housing 403 contacted with the thread sleeve 303 of the base component 300 is regarded as a negative electrode.

In an embodiment, the elastic element 208 includes a spring 206 and a moving sleeve 207 capable of sliding along the pipe cavity 203; the second end of the aerosol generator 400 abuts inside of the moving sleeve 207. To prevent spillage of the tobacco liquid into the air pipe, between outside wall of the housing 403 of the aerosol generator 400 and inside wall of the moving sleeve 207 has a sealing ring; also, between outside wall of the moving sleeve 207 and inside wall of the pipe cavity 203 has a sealing ring. To realize collaborative movement between the aerosol generator 400 and the moving sleeve 207, inside wall of the moving sleeve 207 has a boss 209, the second end of the aerosol generator 400 has a flange 405 configured for abutting against the boss 209.

Figure 3:
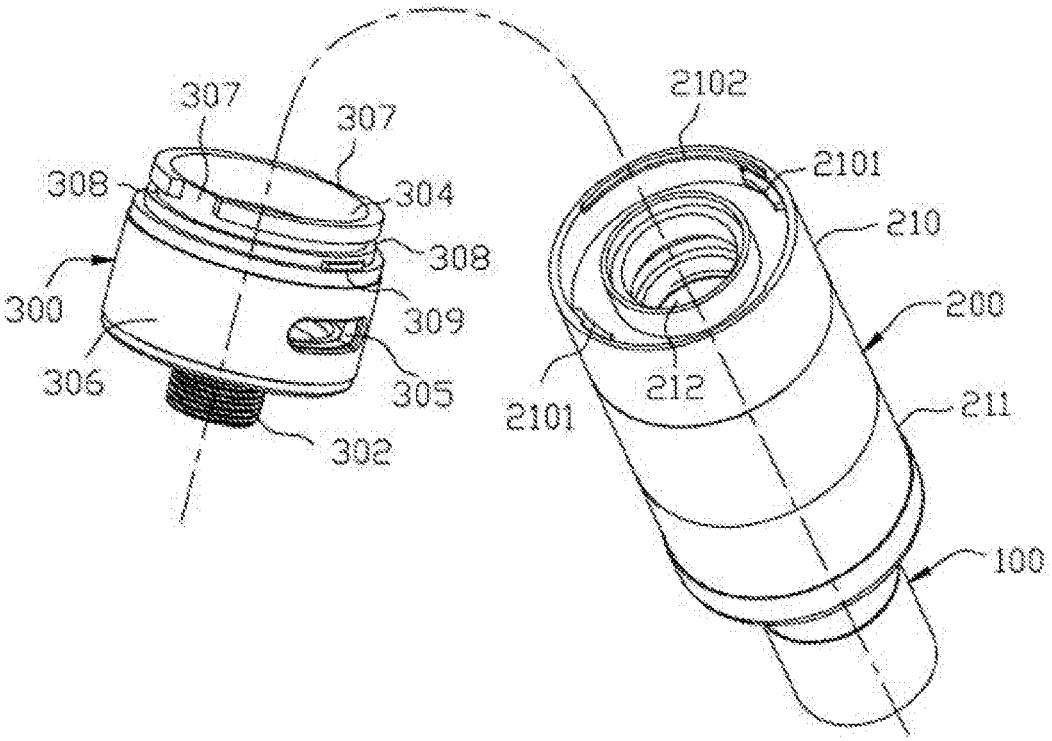
FIG. 3 is a perspective view of a connecting structure between the base component and the atomizer body according to embodiments.

With reference to FIG. 3 which omits the aerosol generator 400, in this embodiment, the base component 300 and the atomizer body 200 are connected by snap joint. The base component 300 has a pair of notches 307 along an axis of the base component 300, and a first arc groove 308 along a radial direction thereof; an end of the atomizer body 200 connected with the base component 300 has at least a first protruding part 2101, preferably there are two protruding parts 2101, the first protruding part 2101 is configured for catching the first arc groove 308 by snap joint after inserting through the notch 307 and rotating with a certain angle, whereas opposite rotating the first protruding part 2101 may open the snap joint. Under the elastic force of the elastic element 208, the base component 300 may not be rotated to open because of malfunction. Compared with the thread connection, the base component 300 needs to be rotated to a comparatively small angle, such as 90 degree, to realize disassembly of the aerosol generator 400.

In some embodiments, an end of the atomizer body 200 includes a pair of symmetrical arc slits 2102 for limiting the angle of the base component 300 rotating. The arc slit 2102 and the above first protruding part 2101 are arranged on the upper holder 210. The base component 300 has a pair of lugs 309 matched with the arc slits 2102 respectively; enabling the base component 300 to move within the radian of the arc slit 2102. The above arc slit 309 and the first arc groove 308 are staggered along the axial direction of the base component 300, not on same sectional surface of the base component 300. Similarly, the arc slits 2102 and the first protruding part 2101 are staggered along the axial direction of the lower holder 210.

Figure 4:
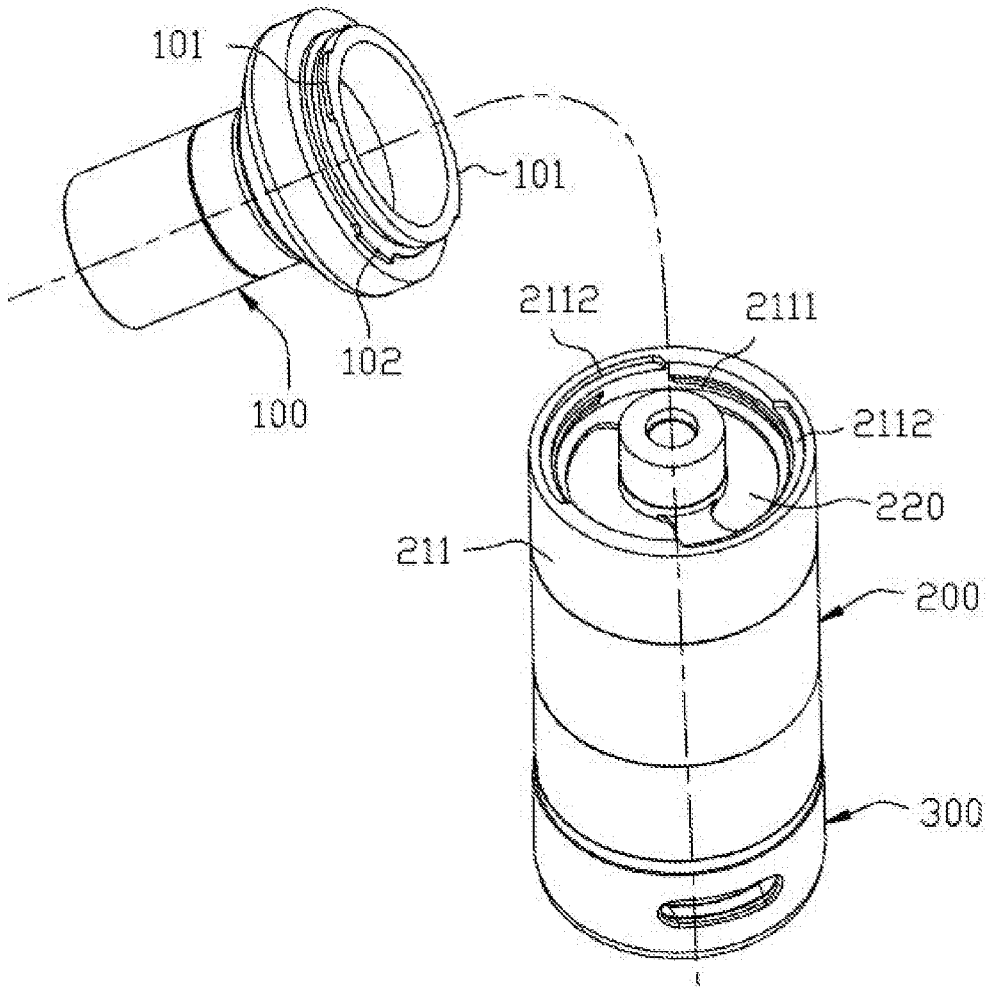
FIG. 4 is a perspective view of a connecting structure between the mouth piece and the atomizer body according to embodiments.

With reference to FIG. 4, the mouth piece 100 and the atomizer body 200 are connected by snap joint, which is similar with the connection of the atomizer body 200 and the base component 300. The other end of the atomizer body 200 has a second arc groove 2111 formed on the upper holder 211. The mouth piece 100 has a second protruding part 101 matched with the second arc groove 2111. Likewise, the upper holder 211 has a pair of arc slits 2112 and the mouth piece 100 has a pair of lugs 102 matched with the arc slits 2112. The users may rotate and open the mouth piece 100 to refill the atomizer, a liquid inlet 220 is opened on the upper holder 211, a injection nozzle of a liquid receptacle may push a sealing membrane 205 open by passing through the liquid inlet 220, consequently refilling the liquid storage chamber 204 with tobacco liquid.

Figure 5:
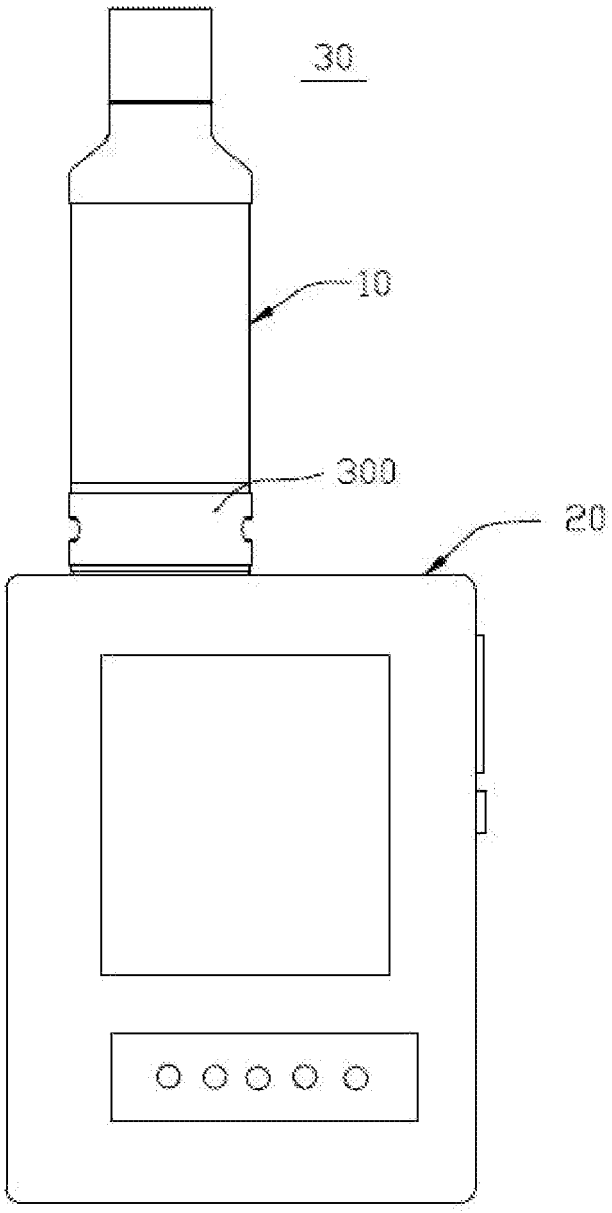
FIG. 5 is an aspect view of an electronic cigarette according to an embodiment.

With reference to FIG. 5, the present disclosure relates to an electric cigarette 30 in an embodiment including the aforementioned atomizer 10 with easy assembly and disassembly, and a power supply set 20 connected with the atomizer 10.

Figure 6:
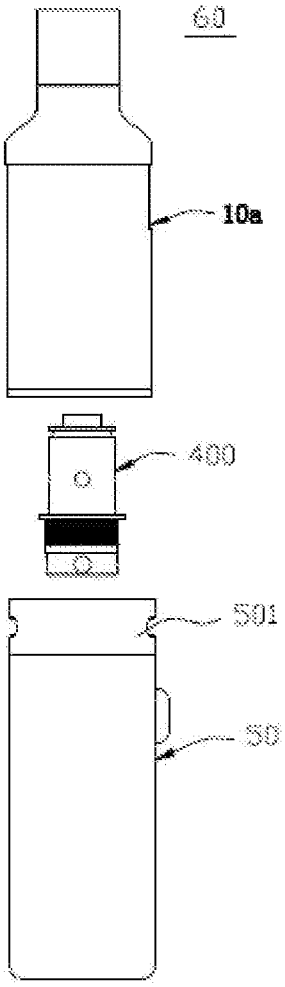
FIG. 6 is an aspect view of an electronic cigarette according to another embodiment.

With reference to FIG. 6, the present disclosure relates to an electric cigarette 60 in another embodiment, different with the electronic cigarette 30. The electronic cigarette 60 includes an atomizer body **10*a* capable of connection by snap joint, a power supply set 50 that has a same shape with the atomizer 10*a*. However, the abovementioned base component 300, an electrode carried thereon and the power supply set 50 are integrally formed as one connecting end 501 of the power supply set 50. The abovementioned snap joint is also defined on the connecting end 501 in favor of connection of the power supply set 50 and a lower end of the atomizer body 10*a* by snap joint, therefore the aerosol generator 400** is abutted against tight.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer with easy assembly and disassembly, comprising:

an atomizer body; a liquid storage chamber formed inside the atomizer body and configured for storing the tobacco liquid;

an aerosol generator, configured for aerosolizing tobacco liquid from the liquid storage chamber to generate an aerosol, and capable of being inserted into the tobacco liquid chamber from an end of the atomizer body;

an air pipe, disposed inside the atomizer body and configured for conducting the aerosol generated by the aerosol generator; and a base component, connecting an end of the atomizer body by snap joint; the base component abuts against a first end of the aerosol generator such that a second end of the aerosol generator connects the air pipe, wherein the air pipe comprises a pipe cavity, configured for receiving the second end of the aerosol generator by inserted into; inside the pipe cavity comprises an elastic element, the elastic element abuts against the second end of the aerosol generator.

2. The atomizer according to claim 1, wherein the elastic element comprises a spring and a moving sleeve capable of sliding along the pipe cavity; the second end of the aerosol generator abuts inside of the moving sleeve.

3. The atomizer according to claim 2, wherein inside wall of the moving sleeve comprises a boss, the second end of the aerosol generator comprises a flange abutted against the boss.

4. The atomizer according to claim 1, wherein the base component comprises a notch along an axis direction of the base component, and a first arc groove along a radial direction thereof; an end of the atomizer body connected with the base component comprises at least a first protruding part configured for catching the first arc groove by snap joint after inserted through the notch and rotated with a certain angle.

5. The atomizer according to claim 4, wherein an end of the atomizer body comprises an arc slit for limiting the angle of the base component rotated; the base component comprises a lug clamped with the arc slit.

6. The atomizer according to claim 1, wherein the aerosol generator comprises a housing, a heating element being disposed in the housing and an annular liquid storage space surrounding the heating element; the housing has a liquid inlet, the tobacco liquid from the liquid storage space is absorbed through the liquid inlet and heated to generate an aerosol.

7. The atomizer according to claim 1, wherein the second end of the aerosol generator away from the connected base component is connected with a mouth piece by snap joint, and comprises a second arc groove; a second protruding part is defined on the mouth piece and connected with the second arc groove by snap joint.

8. An electronic cigarette comprises:

an atomizer with easy assembly and disassembly comprises:

an atomizer body; a liquid storage chamber formed inside the atomizer body and configured for storing the tobacco liquid;

an aerosol generator, configured for aerosolizing tobacco liquid from the liquid storage chamber to generate an aerosol, and capable of being inserted into the tobacco liquid chamber from an end of the atomizer body;

an air pipe, disposed inside the atomizer body and configured for conducting the aerosol generated by the aerosol generator; and a base component, connecting an end of the atomizer body by snap joint; the base component abuts against a first end of the aerosol generator such that a second end of the aerosol generator connects the air pipe, a power supply set connected with the atomizer, wherein the air pipe comprises a pipe cavity, configured for receiving the second end of the aerosol generator by inserted into; inside the pipe cavity comprises an elastic element, the elastic element abuts against the second end of the aerosol generator.

9. The electronic cigarette according to claim 8, wherein the elastic element comprises a spring and a moving sleeve capable of sliding along the pipe cavity; the second end of the aerosol generator abuts inside of the moving sleeve.

10. The electronic cigarette according to claim 9, wherein inside wall of the moving sleeve comprises a boss, the second end of the aerosol generator comprises a flange abutted against the boss.

11. The electronic cigarette according to claim 8, wherein the base component comprises a notch along an axis direction of the base component, and a first arc groove along a radial direction thereof; an end of the atomizer body connected with the base component comprises at least a first protruding part configured for catching the first arc groove by snap joint after inserted through the notch and rotated with a certain angle.

12. The electronic cigarette according to claim 11, wherein an end of the atomizer body comprises an arc slit for limiting the angle of the base component rotated; the base component comprises a lug clamped with the arc slit.

13. The electronic cigarette according to claim 8, wherein the aerosol generator comprises a housing, a heating element being disposed in the housing and an annular liquid storage space surrounding the heating element; the housing has a liquid inlet, the tobacco liquid from the liquid storage space is absorbed through the liquid inlet and heated to generate an aerosol.

14. The electronic cigarette according to claim 8, wherein the second end of the aerosol generator away from the connected base component is connected with a mouth piece by snap joint, and comprises a second arc groove; a second protruding part is defined on the mouth piece and connected with the second arc groove by snap joint.

15. An electronic cigarette comprising:

an atomizer body; a liquid storage chamber formed inside the atomizer body and configured for storing the tobacco liquid;

an aerosol generator, configured for aerosolizing tobacco liquid from the liquid storage chamber to generate an aerosol and capable of being inserted into the tobacco liquid chamber from an end of the atomizer body;

an air pipe, disposed inside the atomizer body and configured for conducting the aerosol generated by the aerosol generator; and a power supply set, configured for supplying power to the aerosol generator, the power supply set is connected with an end of the atomizer body by snap joint; and the power supply set abuts against a first end of the aerosol generator such that a second end of the aerosol generator connects the air pipe, wherein the air pipe comprises a pipe cavity, configured for receiving the second end of the aerosol generator by inserted into; inside the pipe cavity comprises an elastic element, the elastic element abuts against the second end of the aerosol generator.

* * * * *